US009636688B2

(12) United States Patent
Sloan et al.

(10) Patent No.: US 9,636,688 B2
(45) Date of Patent: May 2, 2017

(54) SCREENING APPARATUS

(71) Applicant: CDE Global Limited, Cookstown County Tyrone (GB)

(72) Inventors: Glenn Sloan, Castlerock (GB); Anthony Convery, Moneymore (GB)

(73) Assignee: CDE Global Limited, Cookstown, County Tyrone (GB)

( * ) Notice: Subject to any disclaimer, the term of this patent is extended or adjusted under 35 U.S.C. 154(b) by 5 days.

(21) Appl. No.: 14/412,817

(22) PCT Filed: Jul. 2, 2013

(86) PCT No.: PCT/EP2013/063976
§ 371 (c)(1),
(2) Date: Jan. 5, 2015

(87) PCT Pub. No.: WO2014/006064
PCT Pub. Date: Jan. 9, 2014

(65) Prior Publication Data

US 2015/0158031 A1 Jun. 11, 2015

(30) Foreign Application Priority Data

Jul. 4, 2012 (GB) ..... 1211877.4

(51) Int. Cl.

| | |
|---|---|
| ***B07B 9/00*** | (2006.01) |
| ***B03B 5/04*** | (2006.01) |
| ***B07B 1/46*** | (2006.01) |
| ***B07B 13/16*** | (2006.01) |
| ***B03B 11/00*** | (2006.01) |
| ***D21D 5/04*** | (2006.01) |

(52) U.S. Cl.
CPC ..... *B03B 5/04* (2013.01); *B03B 11/00* (2013.01); *B07B 1/46* (2013.01); *B07B 13/16* (2013.01); *D21D 5/043* (2013.01); *B07B 2230/01* (2013.01)

(58) Field of Classification Search
CPC .. B07B 1/46; B07B 5/04; B07B 11/00; B07B 13/16; B07B 2230/01
USPC ..... 209/269, 314, 326, 405
See application file for complete search history.

(56) References Cited

U.S. PATENT DOCUMENTS 2,267,327 A 12/1941 Ellen
3,206,396 A * 9/1965 Davis ..... B29B 13/06 210/388

(Continued)

OTHER PUBLICATIONS

International Search Report for corresponding PCT Application No. PCT/EP2013/0063976, dated Oct. 30, 2013.

(Continued)

*Primary Examiner* — Joseph C Rodriguez
*Assistant Examiner* — Kalyanavenkateshware Kumar
(74) *Attorney, Agent, or Firm* — Gardner, Linn, Burkhart & Flory, LLP

(57) ABSTRACT

A screening apparatus (10) comprising a frame, a motor assembly (16) for vibrating the frame, at least one screen (20, 30) mounted on the frame for separating materials by size and at least one feed device (35A, 35B, 35C, 35D) provided for delivering a liquid onto said at least one screen (20, 30), said at least one feed device (35A, 35B, 35C, 35D) being adapted to deliver said liquid onto the at least one screen (20, 30) to define a laminar flow of liquid and entrained or suspended solid material over the at least one screen (20, 30).

12 Claims, 9 Drawing Sheets

(56) References Cited

U.S. PATENT DOCUMENTS

| | | | | |
|---|---|---|---|---|
| 3,635,326 | A * | 1/1972 | Langlinais | B65G 69/00 193/2 R |
| 4,027,760 | A | 6/1977 | Somerville | |
| 4,895,653 | A | 1/1990 | Cherochak | |
| 6,871,745 | B2 * | 3/2005 | Lynn | B01D 33/04 209/254 |

OTHER PUBLICATIONS

Uwe Bruder, "High Tech: Fine screening machines from Derrick for wet and dry screening in the sand and gravel industry", AT Mineral Processing, vol. 51, No. 3, Mar. 1, 2010, pp. 64-73.

* cited by examiner

SCREENING APPARATUS

CROSS REFERENCE TO RELATED APPLICATIONS

The present application is a §371 international of International Patent Application No. PCT/EP2013/063976, filed Jul. 2, 2013, which claims the benefit of United Kingdom Patent Application No. GB 1211877.4, filed Jul. 4, 2012, both of which are hereby incorporated herein by reference in their entireties.

FIELD OF THE INVENTION

This invention relates to a screening apparatus.

BACKGROUND OF THE INVENTION

It is often desired to separate material by size, particularly in sand quarrying operations. It is known to provide a screening apparatus for such purpose, such apparatus typically comprising a frame or box, a motor assembly for vibrating the frame, a mesh screen mounted on the frame for separating materials by size and a feed device for delivering solid material, typically entrained or suspended in a flow of water, onto the screen, whereby fine solids, having a grain size smaller than the aperture size of the screen (known as undersize material), pass through the screen for collection/passage onto further processing steps, while solids having a grain size greater than the aperture size of the screen (known as oversize material) are conveyed over the screen to be collected from a downstream end of the screen. The feed device typically comprises a hopper or conveying device located above the screen whereby material to be screened, typically entrained or suspended in a flow of water, is dropped onto the upper surface of the screen.

The flow of water fluidizes the solid material, ensuring that the undersize and oversize materials are able to be separated efficiently while preventing the oversize material from clogging the screen. However, in known systems there is a tendency for the material to become dewatered while still on the screen due to the passage of water through the screen. Attempts have been made to alleviate this problem by spraying additional water onto the screen. However, such attempts result in increased water consumption and are generally not successful in re-fluidizing the solid material.

SUMMARY OF THE INVENTION

According to the present invention there is provided a screening apparatus comprising a frame, a motor assembly for vibrating the frame, at least one screen mounted on the frame for separating material by size and at least one feed device provided for delivering a liquid onto said at least one screen, said at least one feed device being adapted to deliver said liquid onto the at least one screen to define a laminar flow of liquid and entrained or suspended solid material over the at least one screen.

The or at least one of said at least one feed device, preferably an upstream most feed device, may be adapted to deliver a liquid having particles of solid material entrained or suspended therein onto said at least one screen.

Preferably said at least one feed device extends across the width of the at least one screen.

Said at least one feed device may comprise a chamber provided with at least one inlet for receiving a supply of liquid or a liquid having particles of solid material entrained or suspended therein and at least one outlet for delivering said liquid or liquid and solid mixture onto an upper surface of said at least one screen. Preferably said at least one outlet of the at least one feed device is provided adjacent the upper surface of the at least one screen to deliver said liquid onto the upper surface of the at least one screen in a direction substantially parallel to the upper surface of the at least one screen. Preferably said at least one outlet comprises an elongate slot through which said liquid is constrained to pass. Said elongate slot may be defined between upper and lower walls or lips located on either side of said slot, said upper and lower walls or lips constraining the liquid to flow out of the slot in a direction substantially parallel to the upper surface of the adjacent screen. At least respective portions of said upper and lower walls or lips may be arranged substantially parallel to one another.

Said at least one feed device may comprise a hollow box-like structure having a lower wall, an upper wall, a front wall, a rear wall and opposing end walls. In one embodiment said at least one outlet may be defined adjacent an upper end of the front wall. Alternatively said at least one outlet may be defined adjacent a lower end of the front wall. Preferably one of said upper and lower lips extends inwardly from said front wall towards said rear wall of the feed device. A distal edge portion of said lower lip and/or a distal edge portion of said upper lip may be inclined downwardly to redirect water passing out of said feed device into a direction substantially parallel to the upper surface of the adjacent screen. Preferably the lower lip of the at least one outlet is substantially contiguous with an upper surface of the adjacent screen.

In one embodiment said at least one outlet may be provided at or adjacent an upper region of the at least one feed device and said at least one inlet being provided at or adjacent a lower region of the feed device. Alternatively the at least one outlet may be provided at or adjacent a lower region of the feed device, said at least one inlet being provided at or adjacent an upper region of the feed device.

A plurality of baffles may be provided within the at least one feed device between the at least one inlet and the at least one outlet to ensure that any solid material entrained or suspended in the liquid passing through the feed device is evenly mixed and evenly distributed therein. Said plurality of baffles may be provided on one or more removable inserts to enable the baffles to be replaced in the event of wear.

The screening apparatus may comprise a first feed device for delivering a liquid, preferably having a solid material entrained or suspended therein, onto a first screen section mounted on said frame, at least one further feed device for delivering liquid onto at least one further screen section downstream of said first screen section. Said at least on further screen section may be arranged to received material to be screened from a downstream end of said first screen section.

The one or more screen sections may be adjustably mounted on the frame to permit adjustment of the angle of inclination of the or each screen section.

According to a further aspect of the present invention there is provided a feed box for a screening apparatus comprising a chamber provided with at least one inlet for receiving a supply of liquid or a liquid having particles of solid material entrained or suspended therein, and at least one outlet for delivering said liquid or liquid and solid mixture onto an upper surface of said at least one screen to define a laminar flow of liquid and entrained or suspended solid material over the at least one screen.

Preferably said at least one outlet comprises an elongate slot through which said liquid is constrained to pass. Said elongate slot may be defined between upper and lower walls or lips located on either side of said slot, said upper and lower walls or lips constraining the liquid to flow out of the slot in a direction substantially parallel to the upper surface of the adjacent screen.

These and other objects, advantages, purposes, and features of the present invention will become more apparent upon review of the following specification in conjunction with the drawings.

DESCRIPTION OF THE PREFERRED EMBODIMENTS

Figure 1:
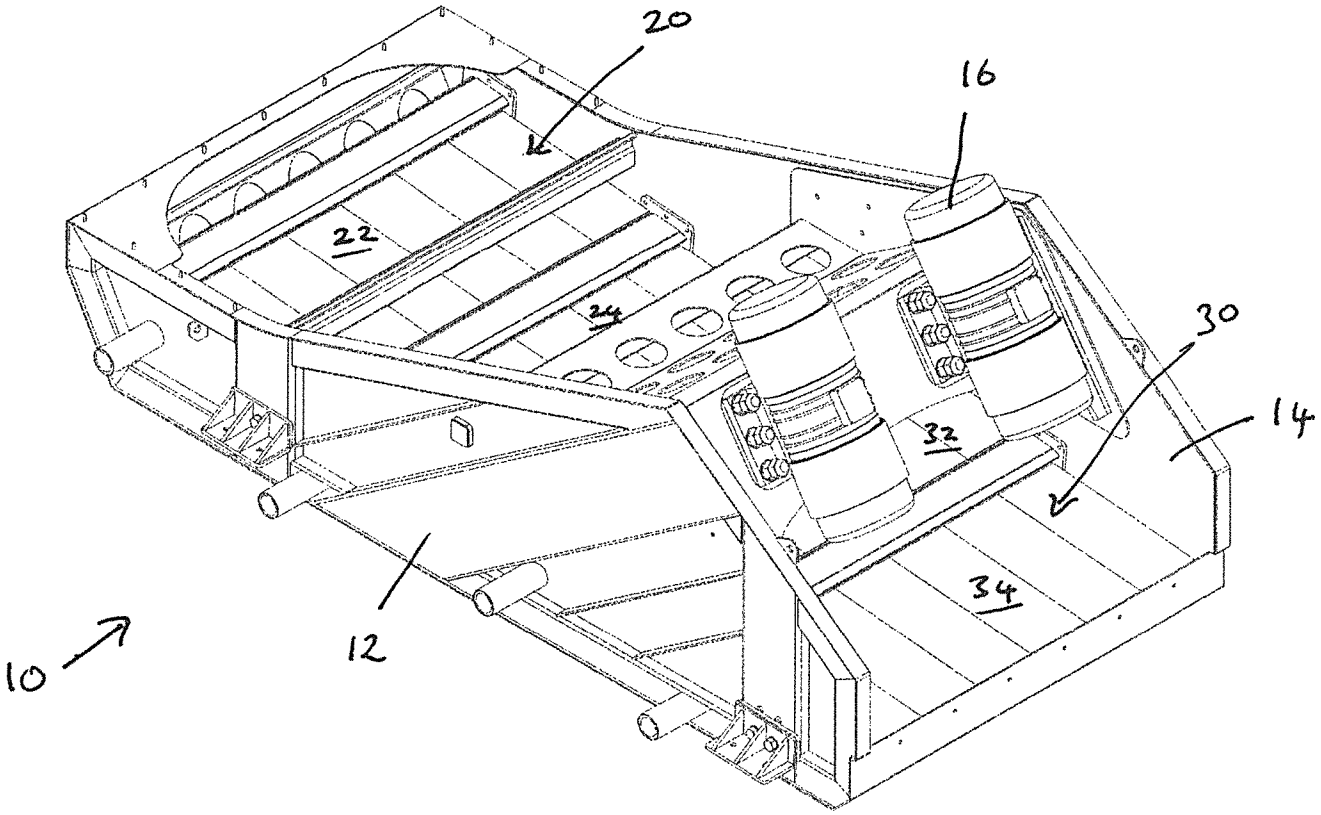
FIG. 1 is a perspective view of a screening apparatus in accordance with an embodiment of the present invention.
Figure 2:
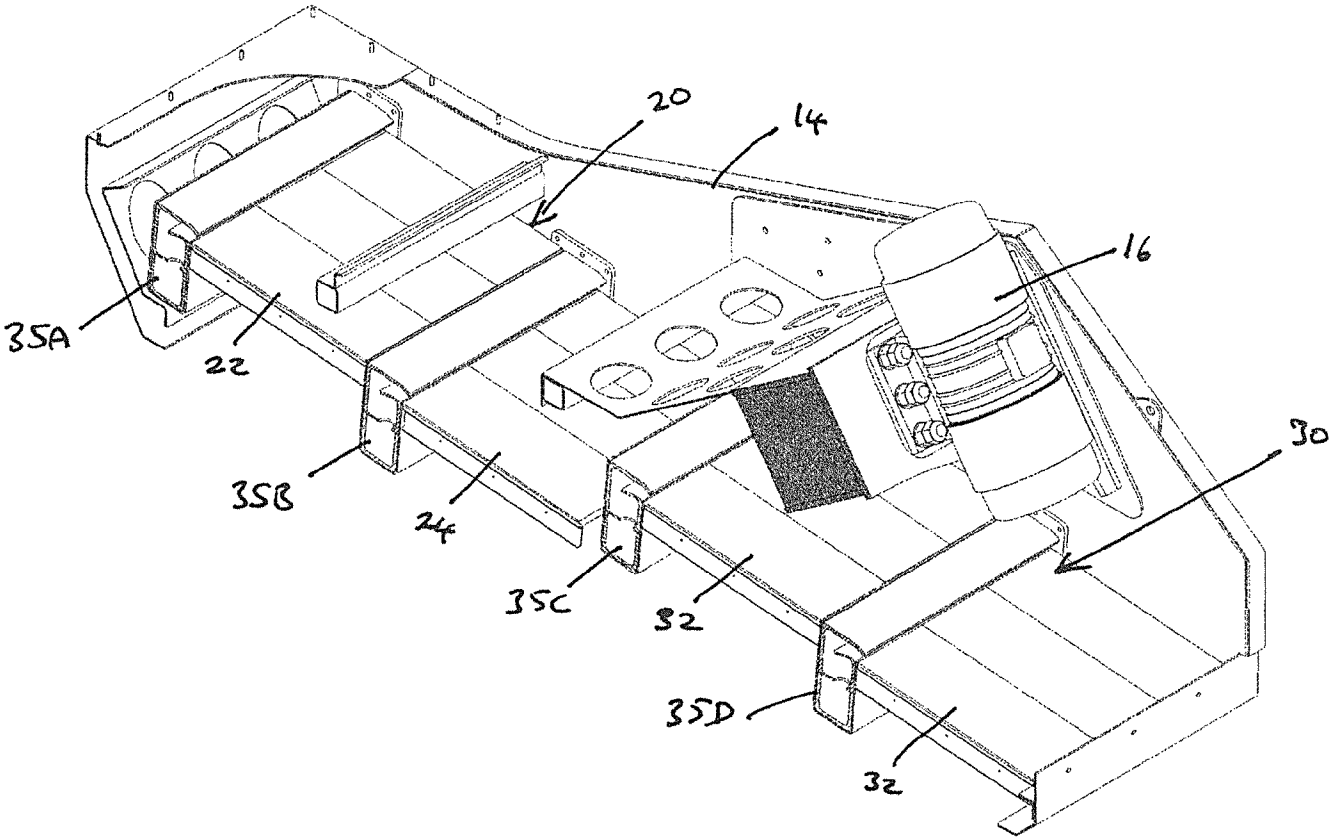
FIG. 2 is a longitudinal sectional perspective view of the apparatus of FIG. 1.
Figure 3:
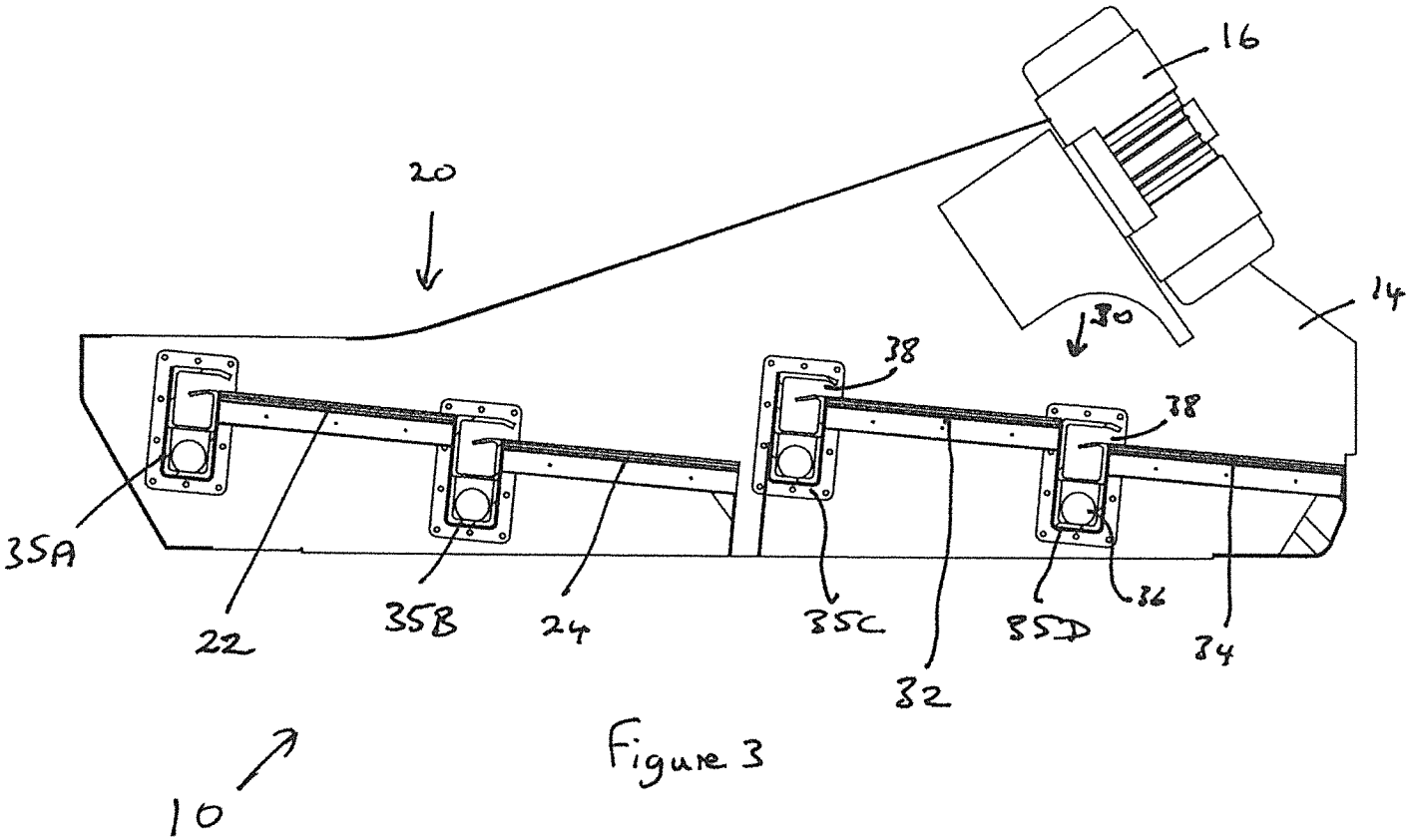
FIG. 3 is a longitudinal sectional view of the apparatus of FIG. 1.
Figure 4:
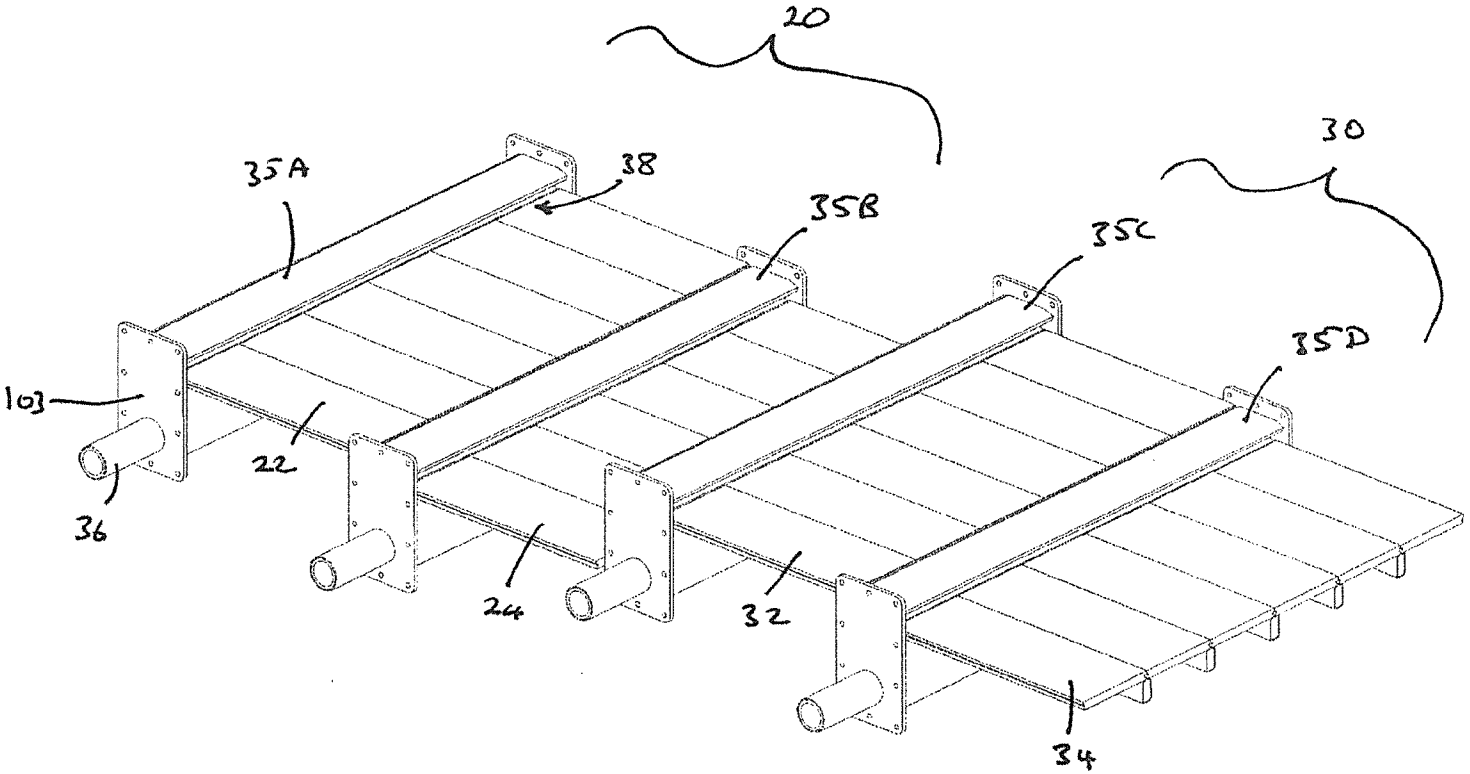
FIG. 4 is a detailed perspective view of the screen assembly of the apparatus of FIG. 1 with the frame omitted for clarity.
Figure 5:
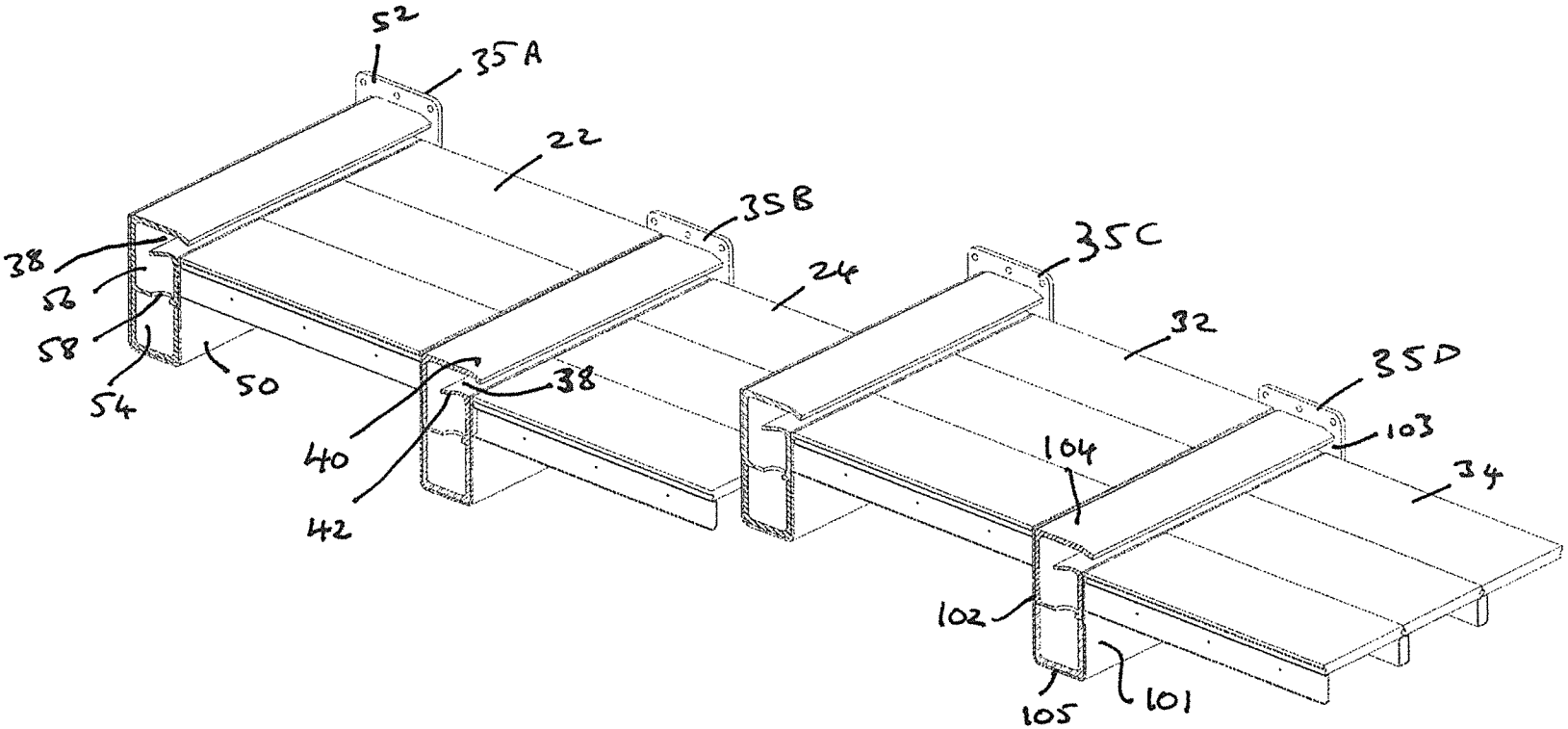
FIG. 5 is a longitudinal sectional perspective view of the screen assembly of FIG. 4.

As illustrated in the drawings, a screening apparatus 10 in accordance with an embodiment of the present invention comprises a frame including a pair of side members 12,14 linked by a plurality transversely extending structural members. A motor assembly 16 is mounted between the side members 12,14 of the frame, the motor assembly 16 comprising a pair of eccentrically mounted motor driven rotors for vibrating the frame.

A pair of screen assemblies 20,30 are mounted between the side members 12,14 of the frame at longitudinally spaced locations along the frame, as will be described in more detail below.

Each screen assembly 20,30 comprising a pair of longitudinally spaced screen sections or decks 22, 24, 32, 34 mounted between the side members 12,14 of the frame, a respective feed box 35A, 35B, 35C, 35D being mounted immediately upstream of each screen section 22, 24, 32, 34 for feeding water onto the surface of the respective screen section to define a laminar flow of water over the surface of thereof. The upstream feed box 35A,35C of each screen assembly 20,30 may be supplied with a mixture of water and particles of solid material to be screened, comprising a mixture of undersize and oversize material, said material being entrained or suspended within said water, such that the mixture is supplied onto the upstream screen section 22,32 of each screen assembly 20,30.

Each feed box 35A, 35B, 35C, 35D comprises a hollow box-like member having a front wall 101, a rear wall 102, a pair of opposing end walls 103, an upper wall 104 and a lower wall 105 (front and rear being defined in the sense of the normal direction of flow of material over each screen assembly 20,30). Each feed box 35A, 35B, 35C, 35D extends between the side members 12,14 of the frame such that the feed boxes define structural components of the frame.

An inlet 36 is provided in one or both end walls 103 of each feed box adjacent the lower wall 105 thereof, whereby water, or a mixture of particles of solid material entrained or suspended in water in the case of each upstream feed box 35A,35C, may be fed into the respective feed box. Alternatively the at least one inlet may be provided in the lower wall 105 of the feed box, or where the at least one outlet is provided adjacent the lower wall 105, the at least one inlet may be provided in the upper wall 104 of the feed box.

In the embodiment shown in FIGS. 1 to 6, an outlet slot 38 of defined in the front wall 101 of each feed box 35A, 35B, 35C, 35D adjacent the upper wall thereof for delivering water onto the adjacent screen section. Each outlet slot 38 is defined by a pair of vertically spaced lips, comprising an upper lip 40 defined by the upper wall 104 of the respective feed box and a lower lip 42 defined by an upper portion of the front wall 101 of the respective feed box extending rearwardly and inwardly from the front wall 101 towards the rear wall 102 of the respective feed box. The upper and lower lips 40,42 are shaped and angled to direct water onto the upper surface of the adjacent screen section in a laminar and even flow across the width of the respective screen section.

Figure 6:
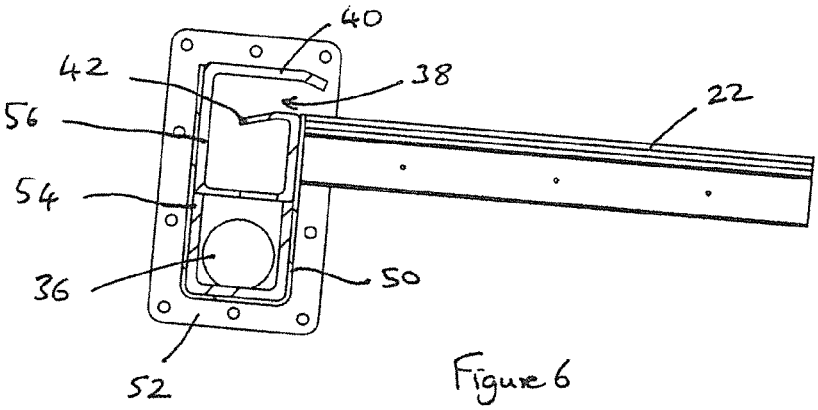
FIG. 6 is a detailed sectional view through a portion of the screen assembly of FIG. 4.

As can be seen from FIG. 6, one or both of the lips 40,42, or at least a terminal edge thereof, are angled downwardly and the lower lip 42 is arranged to lie contiguous with the upper surface 44 of the adjacent screen section such that the water exits the outlet slot 38 parallel to the surface of the adjacent screen section. One or both of the upper and lower lips may be adjustable, or incorporate adjustable or deformable portions, to enable adjustment of the flow of water through the outlet 138.

At least one baffle may be defined within at least each upstream feed box 35A,35C to restrict the flow of water through the feed box, generating mixing and evenly distributing the solid material within the water in the feed box and ensuring that any particles of solid material entrained or suspended in the water are evenly spread across the width of the respective screen section as the mixture leaves the outlet slot 38 of the feed box.

Each feed box may be associated with vibration generating means for maximising agitation of the material passing through the feed box to maintain any particles of solid material, such as sand, in suspension.

Each feed box 35A, 35B, 35C, 35D may comprise a trough like body 50 defining a structural member of the frame and having end plates 52, at least one of which is provided with a water inlet 36. In the embodiment shown in FIG. 6, a first insert member 54 is insertable into the bottom of the body 50 of the feed box and an upper insert member 56, having lip portions 40,42 defining said outlet slot 38, is insertable into the body 50 of the feed box to rest on top of the first insert member 54. Apertures 58 are provided in the base of the upper insert member 56 such that the upper insert member 56 defines said baffle arrangement within the feed box.

Figure 7:
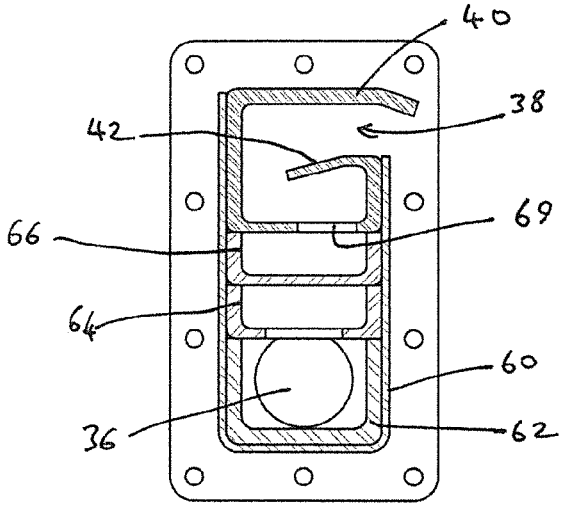
FIG. 7 is a sectional view through a modified embodiment of the feed device of the apparatus of FIG. 1.

In an alternative embodiment, shown in FIG. 7, a plurality of insert members 62, 64, 66, 68 are provided to be received within the body 60 of the respective feed box, the base of each inert member having apertures 69 formed therein such that the insert members define said convoluted baffle arrangement within the respective feed box.

Figure 8:
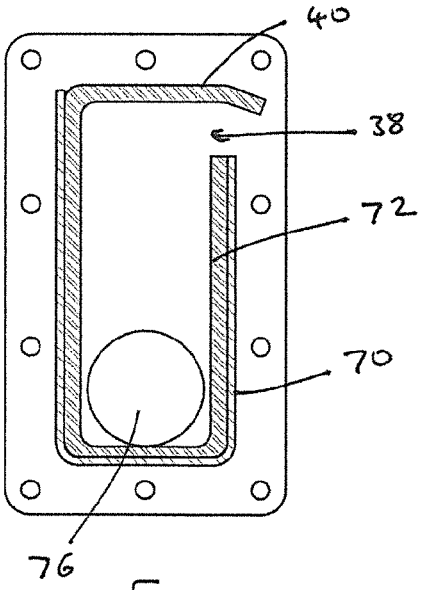
FIG. 8 is a sectional view through a further modified embodiment of the feed device.

The baffle plates may not be required and a single insert member 72, as shown in FIG. 8, may be located within the body 70 of the feed box, said insert member 72 having lip portions defining said outlet slot 38. In the embodiment shown in FIG. 8, only an upper lip 40 may be provided, where such is sufficient for dispensing water and/or a water and solids mixture onto the upper surface of the adjacent screen section to define a laminar flow of water across the screen section to entrain any solid material present into said flow of water. It is envisaged that the solid material may be applied onto the screen section from above to be entrained into the flow of water on the screen. However, it is preferred that the solid material to be screened be passed into the feed box entrained in a flow of water to ensure that the solid material is evenly distributed within the flow of water as it leaves the feed box and is passed onto the adjacent screen section.

As discussed above, each screen assembly 20,30 comprises an upstream screen section 22,32 and a respective downstream screen section 24,34, each screen section having a respective feed box 35A, 35B, 35C, 35D at an upstream side thereof for delivering a laminar flow of water onto the respective screen section. The upstream feed box 35A,35C of each screen assembly 20,30 may be supplied with a mixture of water and particles of solid material entrained or suspended therein, comprising a mixture of oversize and undersize material. Such mixture is delivered onto the upper surface of the upstream screen section 22,32, such that undersize material passes through the screen section 22,32 to be collected therebelow while oversize material flows over the screen section 22,32 and passes onto the respective adjacent downstream screen section 24,24. A flow of water is delivered from the downstream feed box 35B,35D of each screen assembly 20,30 onto the respective downstream screen section 24,34 to fluidize the particles of solid material passing onto the respective downstream screen section 24,34 from the respective upstream screen section 22,32 and to ensure that the mixture flows evenly across the surface of the respective downstream screen section 24,34 to ensure efficient separation of oversize and undersize material on the respective downstream screen section 24,34. Finally oversize material is delivered to a collection region at the downstream end of the respective downstream screen section 24,34 of each screen assembly 20,30, oversize material from the upstream screen assembly 20 passing through a gap 80 defined between the upstream 20 and downstream 30 screen assemblies.

Figure 9:
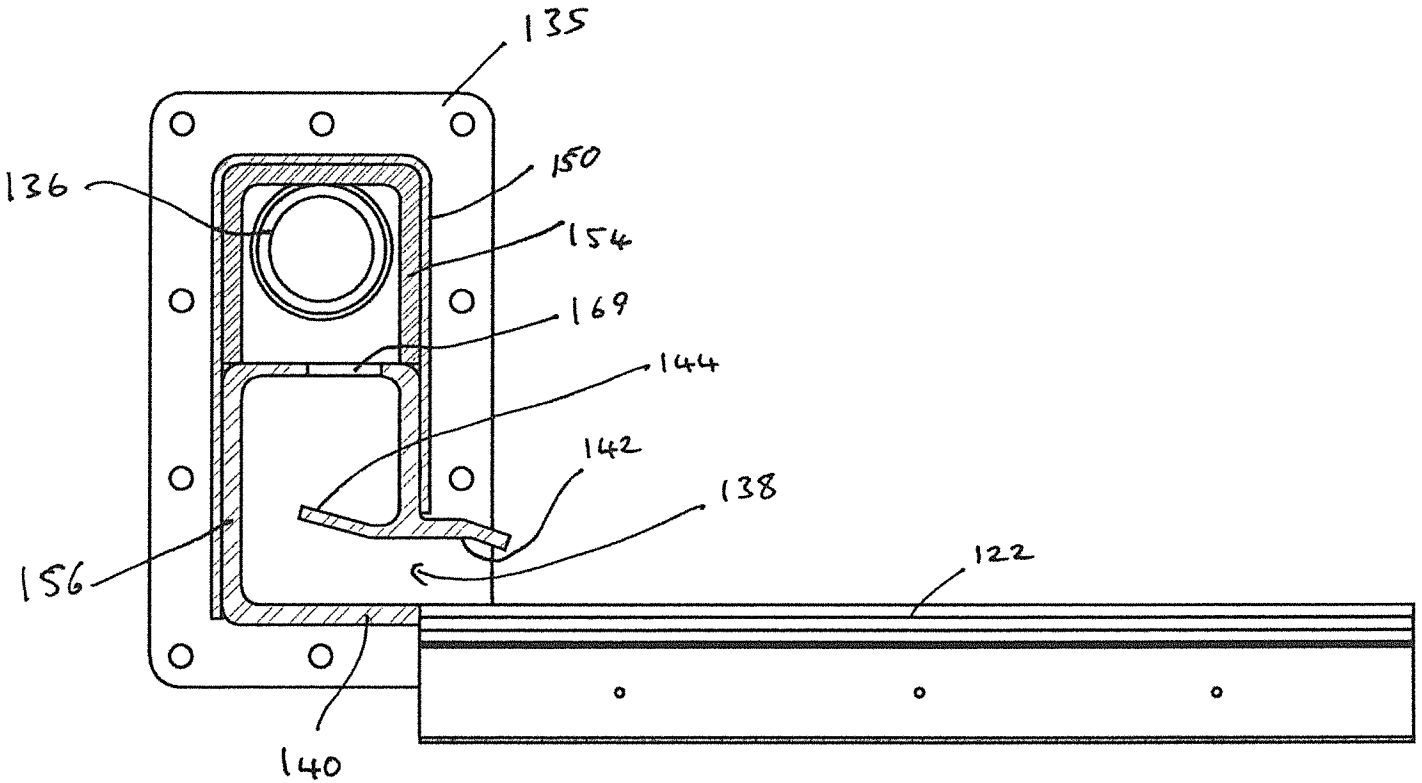
FIG. 9 is a detailed sectional view through a further modified embodiment of the feed device.

In an alternative embodiment, illustrated in FIG. 9, the feed box 135 may be effectively inverted, so that that water, and any solid material entrained therein, enters an upper region of the feed box 135 via one or more inlets 136 located in an upper region of the feed box 135, the water/solids mixture passing out of the feed box onto an upper surface of an adjacent screen section 122 via an elongate outlet slot 138 defined along a lower region of the feed box between lip portions 140,142. The upper lip 142 extends substantially parallel to the lower wall 140 of the feed box and to the upper surface of the screen section 122 to direct the flow of water to define a laminar flow across the screen section. An inner portion 144 of the upper lip 142 extends inwardly from the front wall of the feed box towards the rear wall thereof. By providing the inlet 136 of the feed box 135 adjacent an upper region thereof and the outlet 138 adjacent a lower region, any tendency for solid material to settle out in the feed box 135 is avoided.

As with the previous embodiments, inserts 154,156 are located within the body 150 of the feed box 135, the inserts 154,156 having apertures 169 to define a convoluted flow path through the feed box to ensure that solid material is evenly distributed within the water exiting the feed box.

Figure 10:
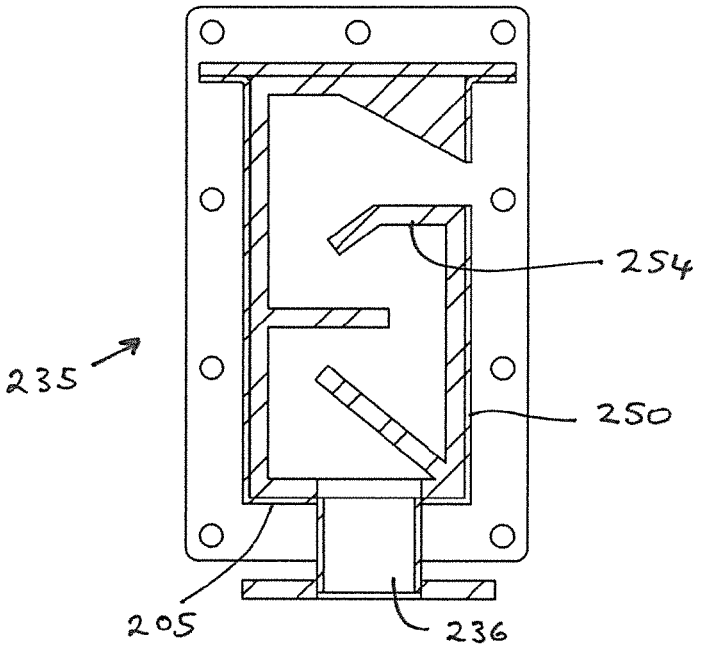
FIG. 10 is a sectional view through a further modified embodiment of the feed device.

As shown in FIG. 10, in a further embodiment, the baffle plates may form part of a single component 254 located within the body 250 of each feed box 235, rather than being formed by numerous insert members.

Figure 11:
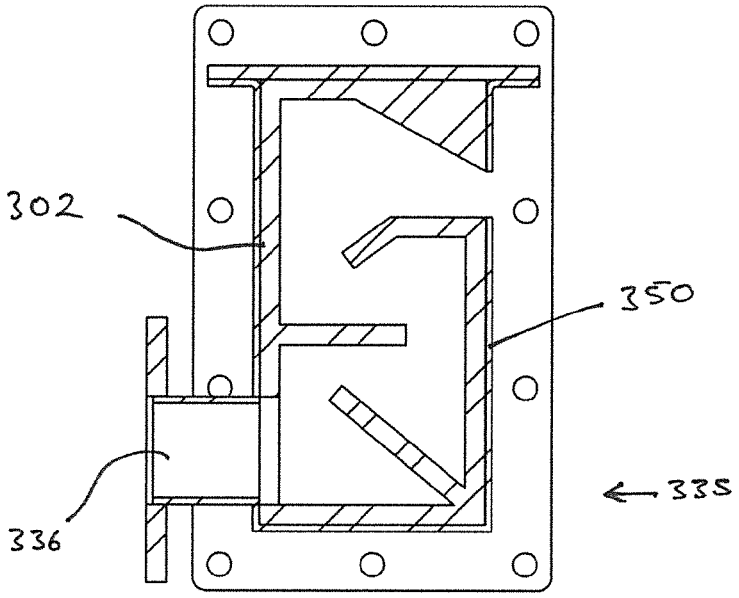
FIG. 11 is a sectional view through a further modified embodiment of the feed device.

In the embodiment shown in FIG. 10, water (within which may be entrained particles of solid material) may be fed into the feed box 235 via an inlet 236 in a bottom wall 205 of the feed box. Alternatively, as illustrated in FIG. 11, the inlet 336 may be formed in a rear wall 302 of the body 350 of the feed box 335.

Where it is desired to add further water to the material downstream of an upstream screen section, the screen box may be modified to receive material from the upstream screen section and mix such material with a flow of water, optionally with additional solid material entrained therein.

Figure 12:
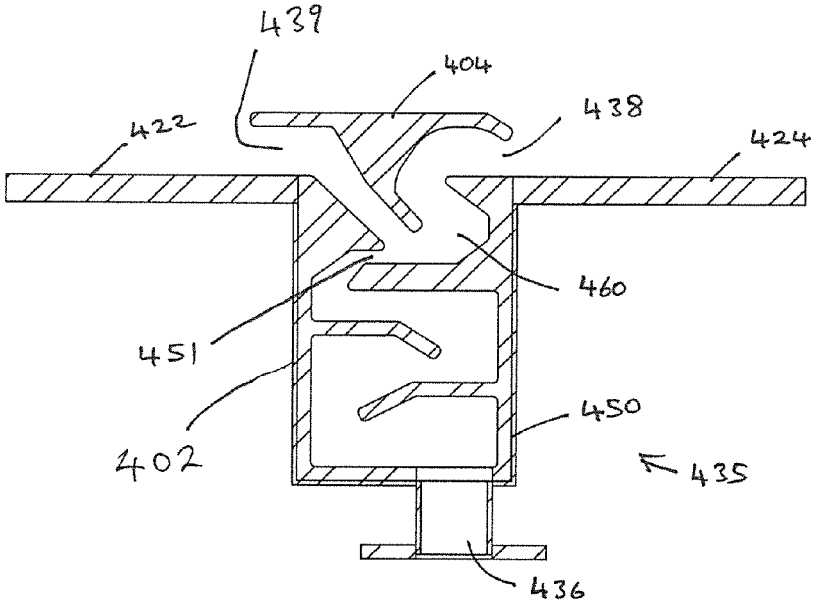
FIG. 12 is a detailed sectional view through a portion of a screen assembly according to a further embodiment of the present invention.

An example of such modified embodiment is shown in FIG. 12, wherein an inlet slot 439 is formed in the rear wall 402 of the feed box 435, adjacent the upper wall 404, said inlet slot 439 communicating with a mixing region 460, defining a convoluted or curved path through the interior of the body 450 of the feed box 435, upstream of the outlet slot 438, such that the material entering the inlet slot 439 from a downstream end of the upstream screen section 422 mixes with and is entrained into the flow of water passing through the body 450 of the screen box 435 in the mixing region 460 before passing out of the screen box 435 onto the downstream screen section 424 via the outlet slot 438. The water flow path through the feed box 435 between the baffles defines a narrowed slot like neck region 451 upstream of said mixing region 460 such that water flows into the mixing region 460 in a blade like jet, ensuring that the particles of solid material are entrained into the flow of water, before passing through the convoluted or "S" shaped mixing region 460 and out of the narrow outlet slot 438, ensuring that the particles of sold material are evenly distributed in the laminar flow of water passing onto the downstream screen section 424.

Figure 13:
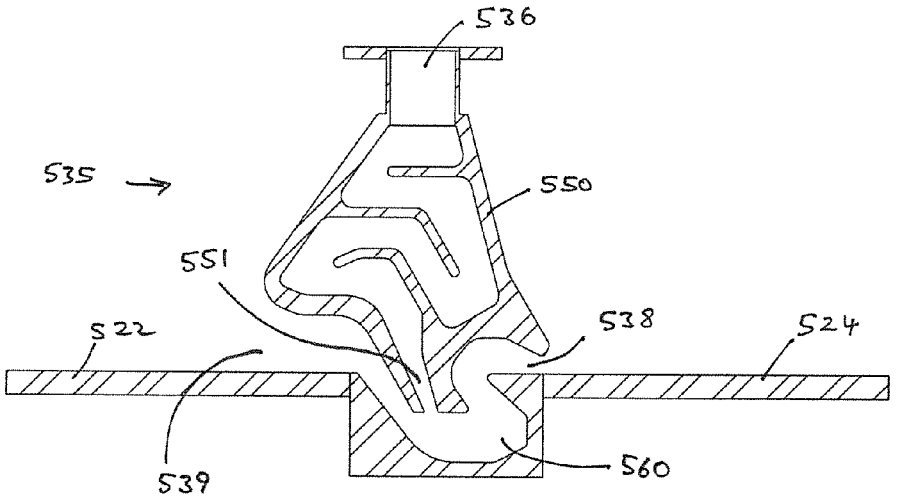
FIG. 13 is a detailed sectional view through a portion of a screen assembly according to a further embodiment of the present invention.

A further embodiment is illustrated in FIG. 13, wherein the inlet and outlet slots 538,539 and mixing region 560 are provided at a lower end of the body 550 of the feed box 535, a water inlet 536 being defined in an upper wall 504 of the feed box 535. As with the embodiment shown in FIG. 12, a narrowed slot like neck region 551 is defined between the baffles within the body 550 of the feed box 535 so that water passes into the mixing region 560 as a blade like jet to entrain the solid material into the flow of water, before passing through the convoluted or "S" shaped mixing region 560 and out of the outlet slot 538 to ensure even mixing of the solid material into the flow of water.

The feed box of the screen apparatus in accordance with the present invention ensures thorough mixing of the solids material in the water flowing over the surface of the screen and maintains the fluidized state of the solid material, ensuring reliable and efficient operation of the screen apparatus while minimising water consumption. The provision of a laminar flow of water and entrained/suspended solids across the surface of the screen enhances the efficiency of the screening process.

The invention is not limited to the embodiment(s) described herein but can be amended or modified without departing from the scope of the present invention. Changes and modifications in the specifically described embodiments can be carried out without departing from the principles of the present invention, which is intended to be limited only by the scope of the appended claims, as interpreted according the principles of patent law, including the doctrine of equivalents.

The invention claimed is:

1. A screening apparatus comprising:

a frame;

a motor assembly for vibrating said frame;

at least one screen mounted on said frame for separating material by size, said at least one screen having an upper surface; and at least one feed device provided for delivering a liquid onto said at least one screen, said at least one feed device comprising a chamber provided with at least one inlet for receiving a liquid having particles of solid material entrained or suspended therein and at least one outlet for delivering said liquid and solid mixture onto said upper surface of said at least one screen;

said at least one feed device comprising a hollow box-like structure defining said chamber, said box-like structure having a lower wall, an upper wall, a front wall, a rear wall and opposing end walls, wherein said at least one outlet is defined adjacent an upper end of said front wall;

wherein said at least one outlet is positioned adjacent said upper surface of said at least one screen, said at least one outlet defining an elongate slot through which the liquid is constrained to pass, and wherein said at least one outlet is operable to deliver the liquid onto said upper surface of said at least one screen in a direction substantially parallel to said upper surface and to thereby establish a laminar flow of liquid and entrained or suspended solid material over said at least one screen; and wherein an upper lip of said elongate slot is defined by said upper wall with a distal edge portion of said upper lip being inclined downwardly towards said adjacent screen.

2. A screening apparatus as claimed in claim 1, wherein said at least one feed device extends across the width of said at least one screen.

3. A screening apparatus as claimed in claim 1, wherein said elongate slot is defined between said upper lip and a lower lip located at said upper end of said front wall, said upper and lower lips constraining the liquid to flow out of said slot in a direction substantially parallel to said upper surface of said adjacent screen.

4. A screening apparatus as claimed in claim 3, wherein at least respective portions of said upper and lower lips are arranged substantially parallel to one another.

5. A screening apparatus as claimed in claim 3, wherein said lower lip is defined by a portion of said front wall extending inwardly towards said rear wall of said feed device.

6. A screening apparatus as claimed in claim 5, wherein a distal edge portion of said lower lip is inclined downwardly.

7. A screening apparatus as claimed in claim 3, wherein said lower lip of said at least one outlet is substantially contiguous with an upper surface of said adjacent screen.

8. A screening apparatus as claimed in claim 1, wherein said at least one outlet is provided at or adjacent an upper region of said at least one feed device, said at least one inlet being provided at or adjacent a lower region of said feed device.

9. A screening apparatus as claimed in claim 8, wherein a plurality of baffles are provided within said at least one feed device between said at least one inlet and said at least one outlet to evenly mix and evenly distribute any solid material entrained or suspended in the liquid passing through said feed device.

10. A screening apparatus as claimed in claim 9, wherein said plurality of baffles are provided by one or more removable inserts to enable said baffles to be replaced in the event of wear.

11. A screening apparatus as claimed claim 1, comprising a first feed device for delivering a liquid onto a first or upstream screen section mounted on said frame, and at least one further feed device for delivering liquid onto at least one further screen section downstream of said first or upstream screen section.

12. A screening apparatus as claimed in claim 11, wherein said at least one further screen section is arranged to receive material to be screened from a downstream end of said first or upstream screen section.

* * * * *